US007815279B2

(12) United States Patent
Veenstra et al.

(10) Patent No.: US 7,815,279 B2
(45) Date of Patent: Oct. 19, 2010

(54) ADJUSTMENT OF PRINT ARRAYS IN A PRINTING DEVICE

(75) Inventors: Hylke Veenstra, Reuver (NL); Jaap J. Mattheijer, Rosmalen (NL); Matheus Wijnstekers, Velden (NL); Joseph L. M. Nelissen, Venlo (NL)

(73) Assignee: OCE-Technologies B.V., Venlo (NL)

( * ) Notice: Subject to any disclaimer, the term of this patent is extended or adjusted under 35 U.S.C. 154(b) by 241 days.

(21) Appl. No.: 12/000,750

(22) Filed: Dec. 17, 2007

(65) Prior Publication Data

US 2008/0143768 A1 Jun. 19, 2008

(30) Foreign Application Priority Data

Dec. 19, 2006 (EP) ..... 06126503

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS 4,675,696 A 6/1987 Suzuki et al.
6,164,745 A * 12/2000 Nagoshi et al. ..... 347/15
6,568,782 B1 * 5/2003 Haselby ..... 347/19

* cited by examiner

*Primary Examiner*—Matthew Luu
*Assistant Examiner*—Justin Seo
(74) *Attorney, Agent, or Firm*—Birch, Stewart, Kolasch & Birch, LLP

(57) ABSTRACT

A method for adjusting a first and a second array relative to each other in a printing device has a carrying structure for mounting the first and second arrays. The first array has nozzles arranged in a first row substantially parallel to a first direction for forming first marks on a recording substrate. The second array has nozzles arranged in a second row substantially parallel to the first direction for forming second marks on the recording substrate. In an attainable relative position, the first and second arrays at least partially flank each other. The method includes forming a test pattern and detecting the locations of first and second test marks; determining a plurality of deviation factors for a plurality of attainable relative positions; and selecting an attainable relative position among the plurality of attainable relative positions that satisfies a selection criterion applied to the plurality of deviation factors.

18 Claims, 8 Drawing Sheets

| Mark # | x (a.u.) |
|---|---|
| 24a | -10 |
| 22a | 50 |
| 24b | 90 |
| 22b | 110 |
| 24c | 150 |
| 22c | 190 |
| 24d | 250 |
| 22d | 290 |
| 24e | 300 |
| 22e | 370 |
| 24f | 410 |
| 22f | 450 |
| 24g | 470 |
| 22g | 510 |
| 24h | 570 |
| 22h | 610 |
| 24i | 650 |
| 22i | 670 |
| 24j | 710 |
| 22j | 770 |
| 24k | 810 |
| 22k | 850 |
| 24l | 870 |
| 22l | 910 |
| 24m | 970 |
| 22m | 1010 |
| 24n | 1050 |
| 22n | 1070 |
| 24o | 1110 |
| 22o | 1170 |
| 24p | 1210 |
| 22p | 1250 |
| 24q | 1270 |
| 22q | 1310 |
| 24r | 1370 |
| 22r | 1410 |
| 24s | 1450 |
| 22s | 1470 |
| 24t | 1510 |
| 22t | 1570 |
| 24u | 1610 |
| 22u | 1650 |

FIG. 6

POSITION P1

L1

| | | | |
|---|---|---|---|
| $d_{11}$= | 60 | $\Delta_{11}$= | 20 |
| $d_{12}$ | 40 | $\Delta_{12}$ | 0 |
| $d_{13}$ | 20 | $\Delta_{13}$ | 20 |
| $d_{14}$ | 40 | $\Delta_{14}$ | 0 |
| $d_{15}$ | 40 | $\Delta_{15}$ | 0 |
| $d_{16}$ | 60 | $\Delta_{16}$ | 20 |
| $d_{17}$ | 40 | $\Delta_{17}$ | 0 |
| $d_{18}$ | 10 | $\Delta_{18}$ | 30 |
| $d_{19}$ | 70 | $\Delta_{19}$ | 30 |
| $d_{110}$ | 40 | $\Delta_{110}$ | 0 |
| $d_{111}$ | 40 | $\Delta_{111}$ | 0 |
| $d_{112}$ | 20 | $\Delta_{112}$ | 20 |
| $d_{113}$ | 40 | $\Delta_{113}$ | 00 |
| $d_{114}$ | 60 | $\Delta_{114}$ | 20 |
| $d_{115}$ | 40 | $\Delta_{115}$ | 0 |
| $d_{116}$ | 40 | $\Delta_{116}$ | 0 |
| $d_{117}$ | 20 | $\Delta_{117}$ | 20 |
| $d_{118}$ | 40 | $\Delta_{118}$ | 0 |
| $d_{119}$ | 60 | $\Delta_{119}$ | 20 |
| $d_{120}$ | 40 | $\Delta_{120}$ | 0 |
| $d_{121}$ | 40 | $\Delta_{121}$ | 0 |
| $d_{122}$ | 20 | $\Delta_{122}$ | 20 |
| $d_{123}$ | 40 | $\Delta_{123}$ | 0 |
| $d_{124}$ | 60 | $\Delta_{124}$ | 20 |
| $d_{125}$ | 40 | $\Delta_{125}$ | 0 |
| $d_{126}$ | 40 | $\Delta_{126}$ | 0 |
| $d_{127}$ | 20 | $\Delta_{127}$ | 20 |
| $d_{128}$ | 40 | $\Delta_{128}$ | 0 |
| $d_{129}$ | 60 | $\Delta_{129}$ | 20 |
| $d_{130}$ | 40 | $\Delta_{130}$ | 0 |
| $d_{131}$ | 40 | $\Delta_{131}$ | 0 |
| $d_{132}$ | 20 | $\Delta_{132}$ | 20 |
| $d_{133}$ | 40 | $\Delta_{133}$ | 0 |
| $d_{134}$ | 60 | $\Delta_{134}$ | 20 |
| $d_{135}$ | 40 | $\Delta_{135}$ | 0 |
| $d_{136}$ | 40 | $\Delta_{136}$ | 0 |
| $d_{137}$ | 20 | $\Delta_{137}$ | 20 |
| $d_{138}$ | 40 | $\Delta_{138}$ | 0 |
| $d_{139}$ | 60 | $\Delta_{139}$ | 20 |
| $d_{140}$ | 40 | $\Delta_{140}$ | 0 |
| $d_{141}$ | 40 | $\Delta_{141}$ | 0 |

FIG. 7A

POSITION P3

L3

| | | | |
|---|---|---|---|
| $d_{35}$= | 60 | $\Delta_{35}$= | 20 |
| $d_{36}$ | 40 | $\Delta_{36}$ | 0 |
| $d_{37}$ | 20 | $\Delta_{37}$ | 20 |
| $d_{38}$ | 30 | $\Delta_{38}$ | 10 |
| $d_{39}$ | 50 | $\Delta_{39}$ | 10 |
| $d_{310}$ | 60 | $\Delta_{310}$ | 20 |
| $d_{311}$ | 40 | $\Delta_{311}$ | 0 |
| $d_{312}$ | 20 | $\Delta_{312}$ | 20 |
| $d_{313}$ | 60 | $\Delta_{313}$ | 20 |
| $d_{314}$ | 40 | $\Delta_{314}$ | 0 |
| $d_{315}$ | 40 | $\Delta_{315}$ | 0 |
| $d_{316}$ | 40 | $\Delta_{316}$ | 0 |
| $d_{317}$ | 20 | $\Delta_{317}$ | 0 |
| $d_{318}$ | 40 | $\Delta_{318}$ | 0 |
| $d_{319}$ | 60 | $\Delta_{319}$ | 20 |
| $d_{320}$ | 40 | $\Delta_{320}$ | 0 |
| $d_{321}$ | 20 | $\Delta_{321}$ | 20 |
| $d_{322}$ | 40 | $\Delta_{322}$ | 0 |
| $d_{323}$ | 60 | $\Delta_{323}$ | 20 |
| $d_{324}$ | 40 | $\Delta_{324}$ | 0 |
| $d_{325}$ | 40 | $\Delta_{325}$ | 0 |
| $d_{326}$ | 40 | $\Delta_{326}$ | 0 |
| $d_{327}$ | 20 | $\Delta_{327}$ | 20 |
| $d_{328}$ | 40 | $\Delta_{328}$ | 0 |
| $d_{329}$ | 60 | $\Delta_{329}$ | 20 |
| $d_{330}$ | 40 | $\Delta_{330}$ | 0 |
| $d_{331}$ | 20 | $\Delta_{331}$ | 0 |
| $d_{332}$ | 60 | $\Delta_{332}$ | 20 |
| $d_{333}$ | 60 | $\Delta_{333}$ | 20 |
| $d_{334}$ | 40 | $\Delta_{334}$ | 0 |
| $d_{335}$ | 40 | $\Delta_{335}$ | 0 |
| $d_{336}$ | 40 | $\Delta_{336}$ | 0 |
| $d_{337}$ | 20 | $\Delta_{337}$ | 20 |
| $d_{338}$ | 40 | $\Delta_{338}$ | 0 |
| $d_{339}$ | 60 | $\Delta_{339}$ | 20 |
| $d_{340}$ | 40 | $\Delta_{340}$ | 0 |
| $d_{341}$ | 20 | $\Delta_{341}$ | 20 |

FIG. 7B x
y
z
14
20a 20b 20c 20d 20e 20f 20g 20h 20i 20j 20k 20l 20m 20n 20o 20p 20q 20r 20s 20t 20u
12
18a 18b 18c 18d 18e 18f 18g 18h 18i 18j 18k 18l 18m 18n 18o 18p 18q 18r 18s 18t 18u
28

ADJUSTMENT OF PRINT ARRAYS IN A PRINTING DEVICE

CROSS-REFERENCE TO RELATED APPLICATIONS

This application claims priority under 35 U.S.C. §119(a) to Application No. 06126503.9 filed in the European Patent Office on Dec. 19, 2006, the entirety of which is expressly incorporated herein by reference.

BACKGROUND OF THE INVENTION

1. Field of the Invention

The present invention relates to a method and apparatus for adjusting a first and a second array relative to each other in a printing device having a carrying structure for mounting the first and second arrays. The first array has nozzles arranged in a first row substantially parallel to a first direction for forming first marks on a recording substrate. The second array has nozzles arranged in a second row substantially parallel to the first direction for forming second marks on the recording substrate. In an attainable relative position, the first and second arrays at least partially flank each other, thereby defining a degree of a longitudinal overlap along the first direction.

The present invention also relates to a computer program product residing on a computer readable medium comprising instructions for causing at least one process unit to perform the method of any the present invention.

2. Description of Background Art

In an ink jet printer known from the background art and having at least a first and a second printhead, a carriage whereon the printheads are mounted is generally moved over a recording substrate in a main scanning direction parallel to a y-axis for the purpose of recording a swath of an image. The first and second printheads have respectively first and second arrays of nozzles extending in a direction substantially parallel to the x-axis, which is the sub-scanning direction. The sub-scanning direction x is perpendicular to the main scanning direction y. An image swath consisting of a certain number of pixel lines, corresponding to the number of activated nozzles of the printheads is thus recorded during a pass of the carriage along the main scan direction. In a given relative position of the first and second arrays along the x-axis, the first and second arrays at least partially flank each other and are arranged for forming respectively first and second marks (also referred to as dots) on a substrate. Some pixel lines are thus constituted by first marks, corresponding to the nozzles of the first row, while other pixel lines are constituted by second marks, corresponding to the nozzles of the second row. Since the first and second rows at least partially flank each other, pixel lines constituted by first marks and pixel lines constituted by second marks both are formed in a same image swath onto the recording substrate during a single pass of the carriage. Generally, interlacing of such pixel lines is desired to obtain a high resolution of the recording image. In addition, the spacing between the lines should be as regular as possible. During one single pass of the carriage with two printheads, a printing resolution twice as high as the resolution of a single printhead may be achieved. Therefore, the relative position of a first and a second printhead along the x-axis has to be adjusted with a high degree of precision. Furthermore, a common error in the positioning of the pixel lines is caused by jet angles which deviate from the ideal jet angle. Such defects may be caused by impurities present in the nozzles. Such defects may lead, for graphical applications, to the appearance of white or light stripes in an image, known as "banding."

A method for adjusting a first and a second array relative to each other in a printing device of the type set forth is known from U.S. Pat. No. 4,675,696. In this patent, a reference pattern is recorded, wherein the reference pattern comprises "recording elements" formed by each printhead for detecting the relative positional aberration of the printheads in the sub-scanning direction. The recorded reference pattern is read for providing an output indicative of the relative locations of the "recording elements." This enables a detection unit to provide an output indicative of the intervals between the printheads in the sub-scanning direction. This is turn enables a control unit to control and adjust the relative position of the printheads in the sub-scanning direction.

However, the method of the background art is not suited for adjusting the relative position of the first and second printheads such that interlaced pixel lines are obtained with a recording resolution twice as high as the resolution of a single printhead. Furthermore, the method according to the background art is not able to solve the problem of "banding."

SUMMARY OF THE INVENTION

An object of the present invention is to improve a method for adjusting a first and a second array relative to each other in a printing device such that interlaced pixel lines can be obtained in a one carriage single pass with a regular spacing between the pixel lines. With a regular spacing between pixel lines, a high resolution image swath can be obtained within a single pass of the carriage. At the same time, the phenomenon of "banding" is significantly reduced.

The above object is achieved by a method for adjusting a first and a second array relative to each other in a printing device, further comprising determining a plurality of deviation factors for a plurality of attainable relative positions based on said detected locations, wherein each one of said deviation factors is an attribute of a distinct attainable relative position and is indicative of an amount by which distances between neighboring first and second marks deviate from a nominal distance, and selecting an attainable relative position among the plurality of attainable relative positions that satisfies a selection criterion applied to the plurality of deviation factors.

Since a deviation factor, which is an attribute of an attainable relative position, is determined, the defects that would appear in the spacing between lines comprising first marks and lines comprising second marks can be quantified for the corresponding attainable relative position. The deviation factor is characteristic of an amount by which distances between pixel lines deviate from a nominal distance. Deviation factors are determined for a plurality of attainable relative positions. Thus, for each of said attainable positions, the defects that would appear in a printed image are quantified. This enables the selection of an attainable relative position which is the optimum attainable relative position of the first and second arrays. To select the optimum attainable relative position, a selection criterion is applied to the plurality of deviation factors attributed to the plurality of attainable relative positions.

In one embodiment of the method according to the present invention, the selected attainable relative position is the one having the smallest deviation factor among the plurality of deviation factors. With such a selection criterion, the selected attainable relative position leads to printed images wherein the appearance of the defects such as caused by deviating jetting angles is minimized.

In another embodiment of the method according to the present invention, a maximum function constrains the deviation factor attributed to a distinct attainable relative position to take the value of the largest difference, in absolute value, among an ensemble of differences computed between the nominal distance and the distances between neighboring first and second marks. The use of this maximum function in order to set the deviation factor leads to the selection of an attainable relative position wherein a large spacing between pixel lines in a printed image are avoided. This embodiment is particularly interesting for applications directed to printed electronics, such as printing etch-resist, where maximum deviations in a printed pattern must be minimized and are more important than uniform distributions in droplet positioning. When this method is applied, reliable printed circuit boards are obtained.

In yet another embodiment of the method according to the present invention, an average function constrains the deviation factor attributed to a distinct attainable relative position to take the value of an averaged difference, computed in absolute value between the nominal distance and the distances between neighboring first and second marks. The use of this average function in order to set the deviation factor leads to the selection of an attainable relative position wherein the averaged spacing between pixel lines is as close as possible to the nominal value. This is particularly of interest for graphical applications and leads to printed images with a good uniformity of the pixel distribution.

In still another embodiment of the method according to the invention, a maximum function constrains the deviation factor attributed to a distinct attainable relative position to take the value of the largest difference between the nominal distance and the distances between neighboring first and second marks. With this maximum function, an attainable relative position may be selected which leads to printed images wherein the image banding is strongly reduced.

In a preferred embodiment, the method according to the present invention further comprises the step of displacing at least one of the first and second arrays for bringing the first and second printheads into the selected relative attainable position. Once this step is carried out, the arrays are positioned relative to each other such that printing under optimal conditions may start. This method may be applied from time to time, in order to calibrate a printing device comprising a first and a second array. Alternately, the method may be applied before every printing session.

The above object of the present invention is also achieved by a printing device comprising a first and a second array mounted on a carrying structure, the first array having nozzles arranged in a first row substantially parallel to a first direction for forming first marks on a recording substrate, the second array having nozzles arranged in a second row substantially parallel to the first direction for forming second marks on the recording substrate, wherein in an attainable relative position, the first and second arrays at least partially flank each other, thereby defining a degree of a longitudinal overlap along the first direction, a displacement device that displaces at least one of the arrays thereby causing a change in the degree of the longitudinal overlap and a control unit that controls the first and second arrays to form a test pattern having first and second test marks and controls a detecting unit that detects the locations of the first and second test marks.

A printing device of the type set forth may be used for graphical applications or for special applications such as printing an etch-resist material on a substrate for printed circuit board manufacturing or printing directly metallic patterns for similar purposes. For graphical applications, a high printing resolution as well as a high productivity are generally required. When a plurality of arrays are positioned relative to each other such that they at least partially flank each other, a high resolution can be achieved in a single pass of a carriage supporting the arrays. In this case, the quality of a printed image depends strongly on the regularity of the spacing between the printed pixel lines obtained in one single pass of the carriage. Therefore, it is important to align the arrays relative to each other such that the spacing is as regular as possible, even in the case that some droplets are jetted according to angles which deviate from the ideal angle. Defects in jet angles may cause the undesired phenomenon of "banding" within a printed swath of an image. With the printing devices of the background art, images that include "banding" are common.

As far as special applications such as printed electronics are concerned, a high accuracy of the placements of the marks on the recording substrate is essential. Indeed, errors in the relative positions of printed lines lead to the occurrence of conductive tracks having errors in spacing widths. This may cause insufficient electrical isolation between adjacent tracks. Moreover, in such applications, a configuration is possible wherein the first and second arrays at least partially flank each other such that the first array is normally used for printing purposes, while the second array is used for backup purposes if malfunctioning of some nozzles of the first array is detected. When this happens, the malfunctioning nozzles of the first array can be set in an inactive state, while nozzles of the second array take over their function. In this kind of application, it is essential that the second marks, formed by the second array, come to lie on the recorded substrate at substantially the same locations as the first marks formed by the first array would do if the first array was functioning properly. In the printing devices of the background art, the second marks are not positioned properly with respect to the desired locations.

Another object of the present invention is to improve a printing device of the type set forth such that the above-mentioned problems are minimized.

This object is achieved in a printing device having a control that controls a computing module to execute the steps of determining a plurality of deviation factors for a plurality of attainable relative positions based on said detected locations, wherein each one of said deviation factors is an attribute of a distinct attainable relative position and is indicative of an amount by which distances between neighboring first and second marks deviate from a nominal distance, and selecting an attainable relative position among the plurality of attainable relative positions which satisfies a selection criterion applied to the plurality of deviation factors.

Since a deviation factor, which is an attribute of an attainable relative position, is determined, the defects that would appear in the spacing between lines comprising first marks and lines comprising second marks can be quantified for the corresponding attainable relative position. The deviation factor is characteristic of an amount by which distances between pixel lines deviate from a nominal distance. Deviation factors are determined for a plurality of attainable relative positions. Thus, for each of said attainable positions, the defects that would appear in a printed image are quantified. This enables the selection of an attainable relative position which is the optimum attainable relative position of the first and second arrays. To select the optimum attainable relative position, a selection criterion is applied to the plurality of deviation factors attributed to the plurality of attainable relative positions.

In one embodiment of the printing device according to the present invention, the control controls the displacement device to cause the first and second arrays to have a degree of longitudinal overlap corresponding to the selected attainable relative position. This enables a calibrating procedure for adjusting the first and second arrays relative to each other which may easily be executed automatically, for example before each time an image is to be printed.

In another embodiment of the printing device according to the present invention, the detecting unit is a CCD camera mounted on a carriage and arranged for scanning the test pattern. Preferably, the CCD camera is arranged for determining a geometrical center of gravity of each one of the first and second test marks in the test pattern and extracting coordinates of said first and second test marks along an axis. With such a CCD camera, the locations of the test marks in the test pattern can be accurately determined. Moreover, with the extracted coordinates, the distances between neighboring first and second marks can also be accurately extracted. This leads to determined deviation factors that properly characterize the defects in an image depending on the attainable relative position.

In yet another embodiment of the printing device according to the present invention, the nozzles of the first array are regularly spaced according to a pitch and the nozzles of the second array are regularly spaced according to the same pitch. This is useful for many applications, such as high resolution graphical applications or printed electronics applications. When the nominal distance is equal to half the pitch, printing with a double resolution may be achieved with a good quality. When the nominal distance is equal to zero, a printing device for printed electronics with a high reliability can be achieved, since the second array can serve as a backup array in the event that some nozzles in the first array have to be set inactive due to their malfunctions.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 6 is a table that associates an x-coordinate to each recorded mark of the test pattern shown in FIG. 4;

FIGS. 7A and 7B list the distances between adjacent first and second points that would arise if the first and second arrays were in the relative position 1 (FIG. 5A) and in the relative position 3 (FIG. 5C), respectively;

DETAILED DESCRIPTION OF THE PREFERRED EMBODIMENTS

Figure 1:
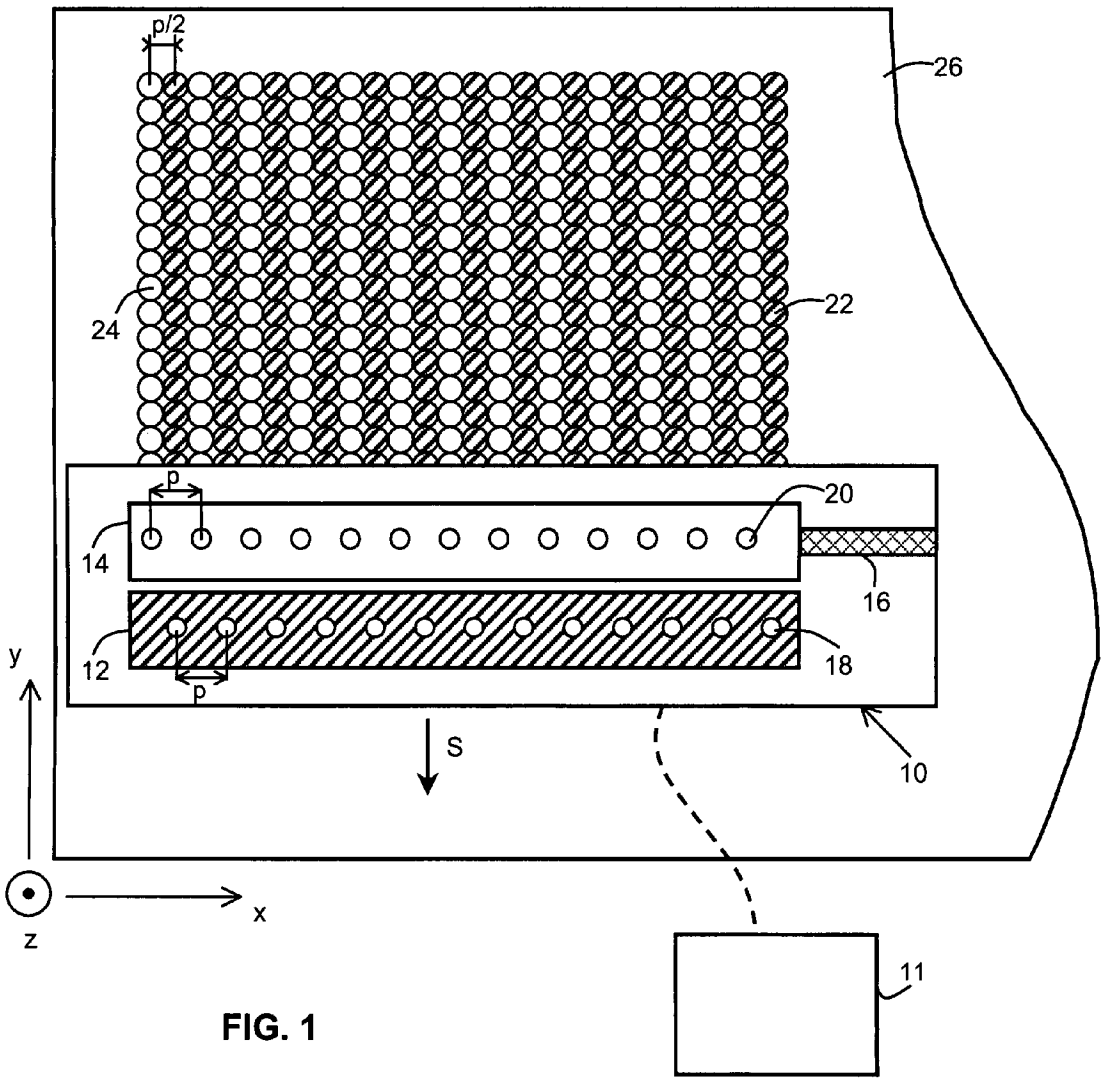
FIG. 1 is a schematic view of essential parts of a printing device having a first and a second printhead, together with an ideal mark pattern recorded on a substrate.

FIG. 1 schematically shows a carriage 10 of an ink jet printer having a first printhead and a second printhead, which are mounted on the carriage 10. The first printhead has a first array 12 of nozzles 18 aligned in a row and the second printhead has a second array 14 of nozzles 20 aligned in a row. Although only two arrays 12 and 14 are shown in the drawing, it is possible to mount additional arrays on the carriage 10. The arrays 12 and 14 may be suited for recording marks of the same marking substance, such as black ink or an etch-resist ink suited for printed electronics applications. The arrays 12 and 14 may also be suited for recording marks of different marking substances such as a conductive material and an etch-resist material. With even more arrays, a full color printer may be obtained, whereby the plurality of additional arrays are used for printing the colors yellow, cyan and magenta. The method for adjusting two arrays such as described hereinafter easily translates to more than two arrays.

The arrays 12 and 14 may be of any type suited for ejecting ink droplets according to a recording signal. A known ink jet printhead with an array of nozzles is provided with a plurality of pressure chambers each of which is fluidly connected on the one hand, via an ink supply path, to an ink reservoir and on the other hand to a nozzle, wherein an actuator is provided for each pressure chamber for pressurizing the ink contained therein, so as to eject an ink droplet through the nozzle in accordance with a recording signal supplied by a control unit. The nozzles are arranged in a row, so that a plurality of pixel lines of an image can be recorded simultaneously. The actuators may be formed by piezoelectric or thermal elements that are arranged along each ink channel. When an ink droplet is to be expelled from a specific nozzle, the associated actuator is energized so that the liquid ink contained in the ink channel is pressurized and an ink droplet is ejected through the nozzle.

The array 12 is provided with a row of nozzles 18 and the array 14 is provided with a row of nozzles 20. Each row extends in a so-called sub-scanning direction, which is parallel to an x-axis. The sub-scanning direction is the direction in which a recording substrate 26 (such as a sheet of paper) is advanced step-wise. In order to print a swath of an image, the carriage 10 is moved across the substrate 26 in a main scanning direction parallel to an y-axis, normal to the x-axis. The control unit 11 is connected to the first printhead with the array 12 and to the second printhead with the array 14 and is arranged for supplying recording signals to the first and second printheads so as to activate image-wise the nozzles.

The carriage 10 has an element 16 configured for adjusting the relative position of the arrays 12 and 14 along the x-axis. The element 16 is mechanically connected to at least one of the arrays, for example the array 14, in order to displace the array along the x-axis such that the relative position of the arrays is modified. The element 16 may be a piezoelectric element adapted to expand and retract along the x-axis, in response to electrical signals supplied by the control unit 11.

In the example shown in FIG. 1, the nozzles 18 of the array 12 are spaced from one another according to a substantially constant pitch p. The nozzles 20 of the array 14 are regularly spaced according to the same pitch p. The array 12 is suited for printing marks (or dots) 22, which result from the ejection of ink droplets out of the nozzles 18, with a resolution along the x-axis substantially equal to 1/p (usually expressed in dots per inch). As is seen in FIG. 1, first pixel lines having first marks 22 are formed on the recording substrate 26 and extend along the y-axis. Similarly, the array 14 is suited for printing marks 24 with the same resolution. Second pixel lines having second marks 24 and extending along the y-axis are formed. When the arrays 12 and 14 are relative aligned such that the nozzles 18 and 20 are in a longitudinal staggered arrangement, a pattern with alternating first and second lines such as shown in FIG. 1 may be obtained, with printing resolution substantially equal to 2/p. To achieve this printing resolution in an image swath with one single pass of the carriage 10, represented by the arrow S, both arrays 12 and 14 are activated image-wise within one single carriage pass. In FIG. 1, a pattern extending along the y-axis is represented, whereby all possible nozzles are activated. However, in practice, the arrays are driven by the control unit 11 in order to activate the nozzles image-wise. For applications such as printed electronics, lines may be recorded using a special etch-resistant ink in order to later on produce tracks of a conductive material by means of an etching process.

Figure 2A:
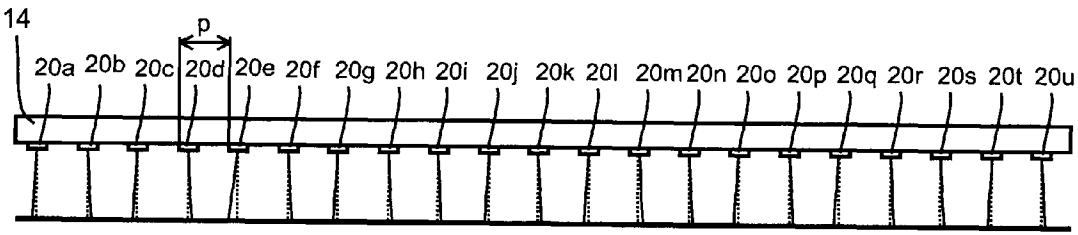
FIGS. 2A and 2B are cross-sectional views of the first and second arrays that show the deviation of the jet angles associated to each nozzle of the arrays.
Figure 2B:
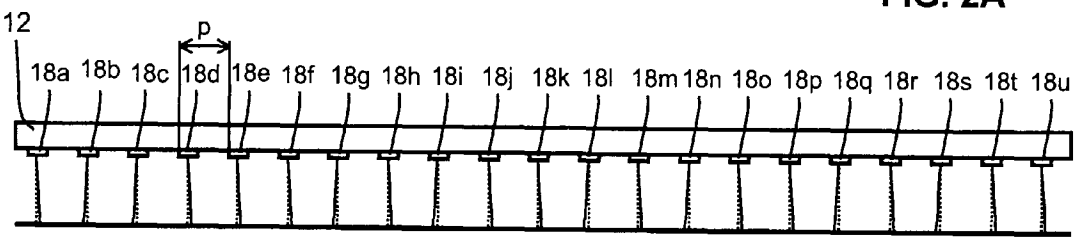
Figure 3:
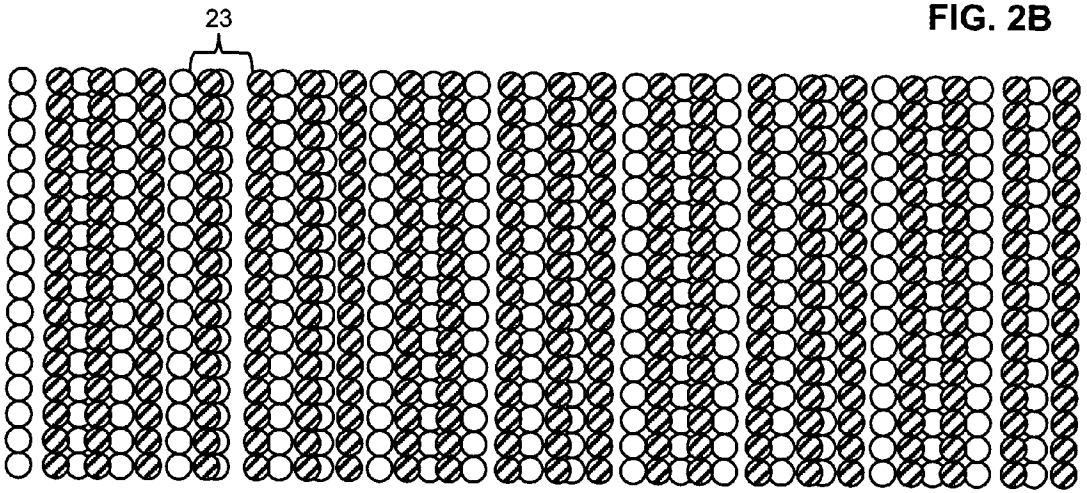
FIG. 3 is a schematic representation of a printed pattern when the arrays are aligned according to a method of the background art.

The recorded pattern with the marks 22 and 24 such as represented in FIG. 1 is however unrealistic, and in practice, a recorded pattern is imperfect. A source of defaults lies within the fact that jet angles considered in the x-z plane deviate from the ideal jet angle of 90 degrees. Deviations of jet angles from the ideal jet angle are illustrated schematically for the nozzles 20 of the array 14 and for the nozzles 18 of the array 12 in FIGS. 2A and 2B, respectively. In these drawings, each of the arrays 14 and 12 is represented according to a cross section and their relative position is assumed to be the same as is shown in FIG. 1. In the rest of the description, the situation is described wherein each array has 21 nozzles (20*a* . . . 20*u* and 18*a* . . . 18*u*), but in reality, an array may comprise much more nozzles. Some nozzles (for example 20*a*, 20*c*, 20*g*, 18*b*, 18*c*, 18*g*, etc.) eject droplets according to a trajectory having a medium deviation to the left. Other nozzles (for example 20*e*) have a major deviation to the left. Yet other nozzles have a minor deviation to the right (for example 20*b*, 20*d*, 20*f*, 18*a*, 18*d*, 18*e*, etc.). The fact that the jet angles deviate from the ideal angle may cause banding in a recorded dot pattern, as is shown in FIG. 3. At some locations of the pattern, undesired empty (or "white") lines appear while at some other locations, undesired dark lines appear due to overlapping. These defects are particularly pronounced in an area 23, wherein a strong overlap as well as a large spacing between vertical lines are visible. The phenomenon of banding is visually unpleasant. For printed electronics application, this leads to isolation problems between conductive tracks.

The pattern represented in FIG. 3 may appear when a background art method for adjusting sidewise the relative position of the arrays is implemented. For example, according to a method according to the background art, the arrays are aligned by a control that utilizes signals from a sensor for determining and controlling the position of reference markers formed on the arrays. The arrays are deemed aligned correctly when such reference markers are brought into registration.

Figure 10:
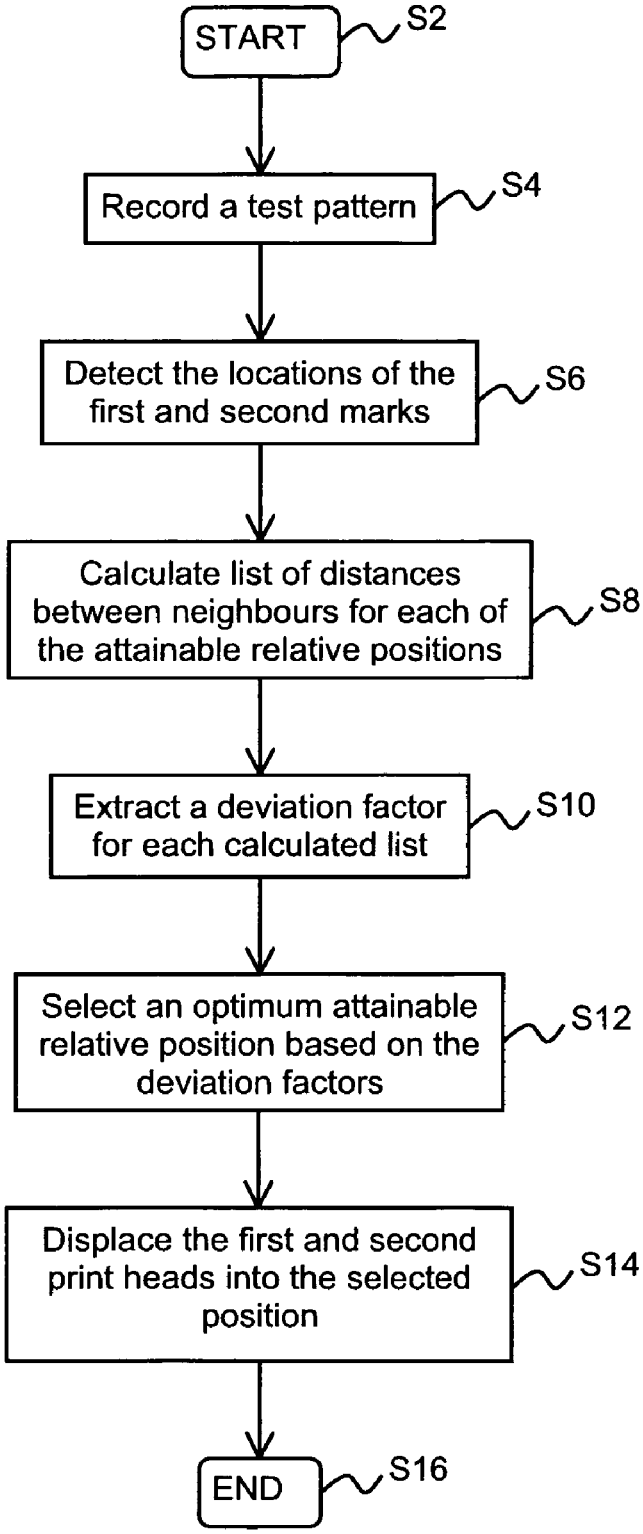
FIG. 10 is flow diagram representing the steps of a method according to an embodiment of the present invention.

A method for adjusting the first and the second array relative to each other according to an embodiment of the present invention will now be described with reference to the flowchart diagram of FIG. 10. The steps of the method may be automated. For this purpose, the control unit 11 is adapted to issue instructions to different modules such as described hereinafter. To perform its tasks, the control unit 11 comprises for example a processor, first memory such as a RAM whereon data may be written during the adjusting procedure and second memory such as an EPROM for storing instructions executable by the processor. Alternately, the procedure may be carried out semi-automatically or manually.

In a first step S2, the adjusting procedure is started by a user in order to launch a program for adjusting the relative position of the arrays, which may be installed on the control unit 11.

Figure 4:
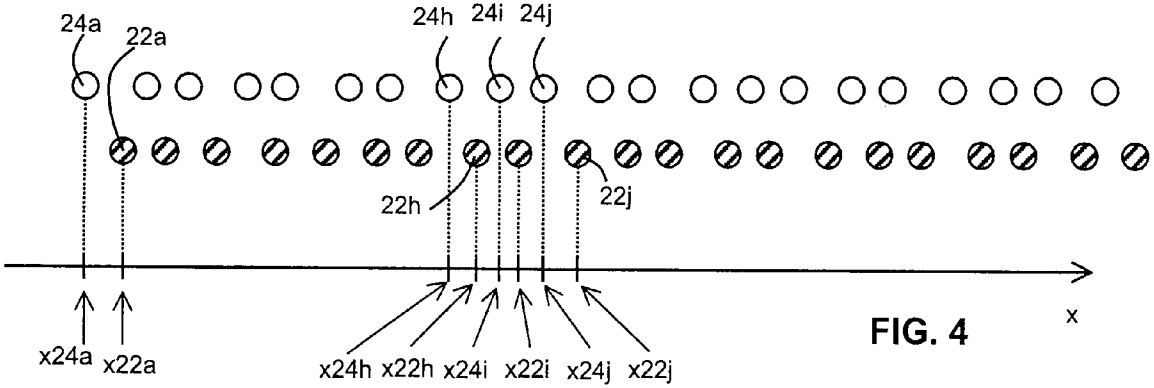
FIG. 4 is a schematic representation of a recorded test pattern comprising test marks, together with the normal projection of the marks onto the x-axis.

In step S4, the control unit 11 issues an instruction to the printing device for recording a test pattern on the recording substrate. In step S4, the first and second arrays are arranged according to an initial relative position, such as shown in FIGS. 2A and 2B. An example of a suitable test pattern is shown in FIG. 4. The test pattern is obtained by activating all nozzles of both arrays such that each nozzle expels at least one ink droplet for forming marks on the recording substrate. When the test pattern shown in FIG. 4 is formed, the arrays 12 and 14 are in the initial position and the carriage 10 is immobile. The recorded test pattern comprises a group of first test marks 22*a* . . . 22*h* . . . 22*j*, etc. and a group of second test marks 24*a* . . . 24*h* . . . 24*j*, etc., whereby both groups extend in a direction parallel to the x-axis. Alternately, to record a test pattern, the arrays 12 and 14 are in the initial position and the carriage 10 is moved along the y-axis in order to form a swath of an image. In this case, when all nozzles are activated while the carriage 10 is moved, pixel lines would be formed on the recording substrate.

In step S6, the control unit 11 issues an instruction to opto-electronic sensors such as a CCD camera (not shown) in order to generate data suited for detecting the locations on the substrate of the first and second test marks of the test pattern. The CCD camera (not shown) may be installed on the carriage 10 of the printing device and is suited for optically scanning the test pattern. The scanned test pattern may then be saved in a suitable image format onto the first memory for further analysis by the control unit 11. Based on the scanned pattern, which is an image comprising data representing the first and second test marks, the location of the first and second test marks are determined by an image analysis software module running on the control unit 11. As is represented in FIG. 4, a normal projection of the recorded first marks defines points having x-coordinates (x22*a* . . . x22*h* . . . x22*i*, etc.). Similarly, a normal projection of the recorded second marks defines points having x-coordinates (x24*a* . . . x24*h* . . . x24*i*, etc.). Based on the determined locations of the first and second test marks, the analysis module of the control unit 11 extracts the x-coordinates of the points and generates a list of x-coordinates corresponding to the recorded first and second marks. An example of such a list is represented in FIG. 6.

Alternately, the CCD camera may be provided with a microprocessor for performing the tasks of determining the locations of the first and second test marks and extracting the x-coordinates. In this case, the CCD camera is preferably arranged for determining a geometrical center of gravity of each recorded test mark. The determination of the centers of gravity leads directly to the x-coordinates (such as exemplified in FIG. 6) which are transmitted by the CCD camera to the control unit 11 via connection device.

Figure 5A:
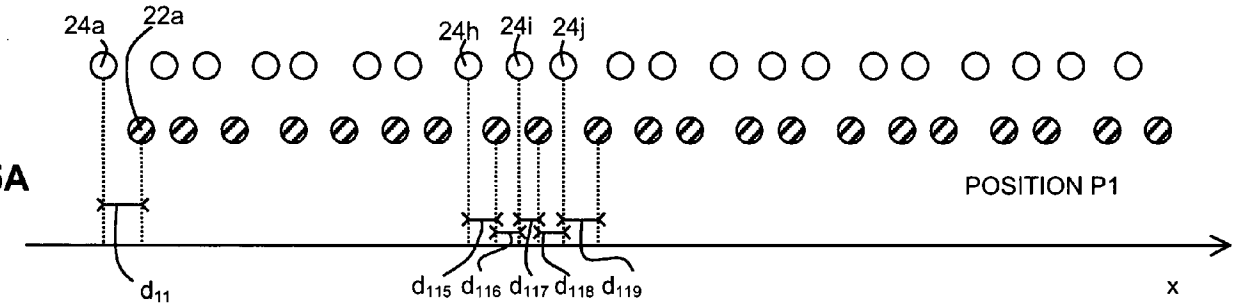
FIGS. 5A to 5F represent mark patterns that would be obtained in six different attainable relative positions of the first and second arrays.

The concept of "an attainable relative position" will now be elucidated. An attainable relative position is a position wherein the first and second arrays at least partially flank each other, thereby defining a degree of longitudinal overlap along the x-axis. The first and second arrays, in an attainable relative position could record a pattern with alternating pixel lines comparable to the initial pattern of FIG. 3, except the fact that the recorded pattern would be less wide in the x-direction since the nozzles falling outside the overlapping area would not be usable anymore. The nozzles are not usable anymore because the resolution would not be acceptable anymore compared to the desired resolution. Indeed, the nozzles falling outside the overlapping area would produce a print resolution equal to 1/p while the nozzles falling within the overlapping area would lead to a resolution equal to 2/p, which is in the example the desired resolution. If the arrays 12 and 14 were brought into a certain attainable position and all their nozzles were activated, the recorded mark pattern would be as is illustrated in FIG. 5A for position P1, in FIG. 5B for position P2, in FIG. 5C for position P3, in FIG. 5D for position P4, in FIG. 5E for position P5 and in FIG. 5F for position P6. The position P1 simply corresponds to the initial position and the degree of longitudinal overlap is 100%. All nozzles may be used to record a pattern. Position P2 corresponds to a position wherein the arrays have been relative displaced along the x-axis by a distance equal to one pitch p. The degree of longitudinal overlap is about 95%. The outermost left nozzle of the array 14, i.e. the nozzle 20*a* is not usable anymore. The same holds for the outermost right nozzle of the array 12, i.e. the nozzle 18*u*. Position P3 corresponds to a position wherein the arrays have been relative displaced along the x-axis by a distance equal to two pitches (2p). The degree of longitudinal overlap is about 90%. The two outermost left nozzles of the array 14, i.e. the nozzles 20*a* and 20*b*, are not usable anymore. The same holds for the two outermost right nozzles of the array 12, i.e. the nozzles 18*u* and 18*t*. In position P4 (see FIG. 5D), the nozzles 20*a*, 20*b*, 20*c*, 18*u*, 18*t* and 18*s* are not usable anymore. In position P4, the degree of longitudinal overlap is about 85%. In position P5 (see FIG. 5E), the nozzles 20*a*, 20*b*, 20*c*, 20*d*, 18*u*, 18*t*, 18*s* and 18*r* are not usable anymore. In position P5, the degree of longitudinal overlap is about 80%. Finally, in position P6 (see FIG. 5F), the nozzles 20*a*, 20*b*, 20*c*, 20*d*, 20*e*, 18*u*, 18*t*, 18*s*, 18*r* and 18*q* are not usable anymore. In position P6, the degree of longitudinal overlap is about 75%. The number of attainable positions may be freely chosen, and depends mainly on the design of the arrays and on choices made for an acceptable minimum print width.

Ideally, the projected distance onto the x-axis between adjacent first and second marks should be equal to a nominal distance. In the present example, the nominal distance is equal to half the pitch p. Here, the pitch p is supposed to be equal to 80 arbitrary units (a.u.) Therefore, the projected distance between adjacent first and second marks should ideally be equal to 40 a.u (the nominal distance). In step S8, a list of distances between first and second neighboring marks is computed by the control unit 11 for each one of the attainable relative positions of the first and second arrays. The term "neighboring marks" relates to first and second marks which are located next to each other. A distance between first and second neighboring marks may be the projected distance onto the x-axis that would arise between adjacent first and second points if the first and second arrays were brought into one of the attainable relative positions. In FIGS. 5A to 5F, a number of distances between first and second neighboring marks are illustrated. For example, for the position P1 shown in FIG. 5A, $d_{11}$ is the projected distance between the second mark 24*a* and the first mark 22*a*. The distance $d_{11}$ is simply obtained by the relationship $d_{11}$=x22*a*−x24*a*. In this position P1, other examples of relationships are the following: $d_{115}$=x22*h*−x24*h*; $d_{116}$=x24*i*−x22*h* and so on. Hence, based on the x-coordinates represented in the table in FIG. 6, a list $L_1$ of distances between first and second neighboring marks is computed for the relative position P1 and is illustrated in FIG. 7A.

Figure 5B:
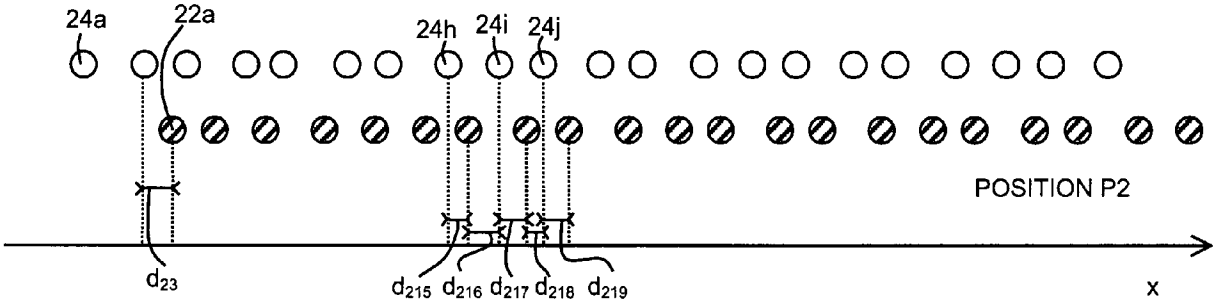
Figure 5C:
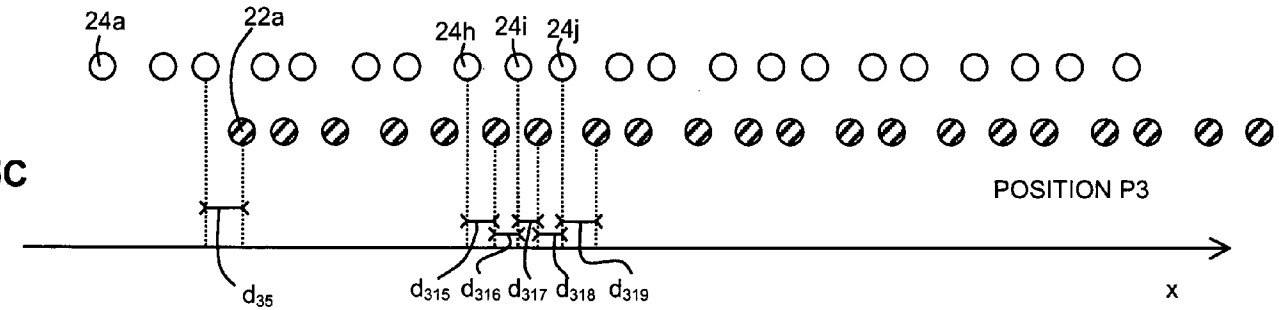
Figure 5D:
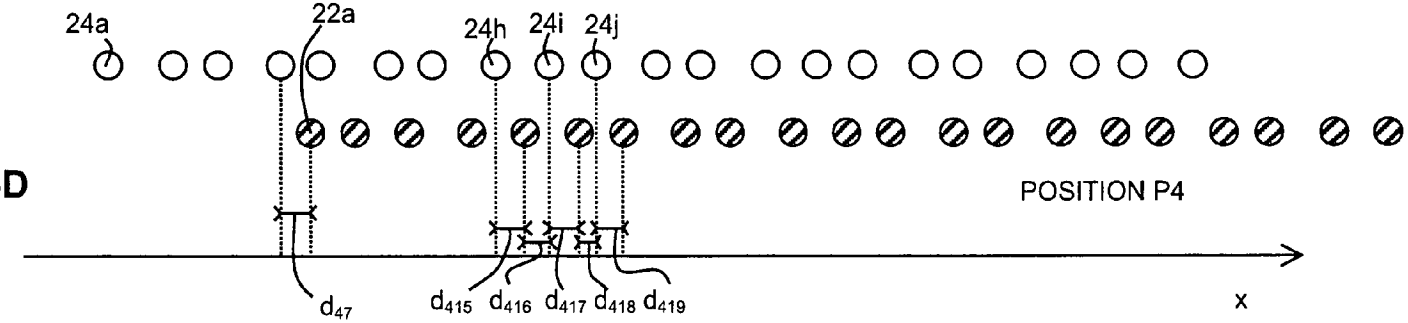
Figure 5E:
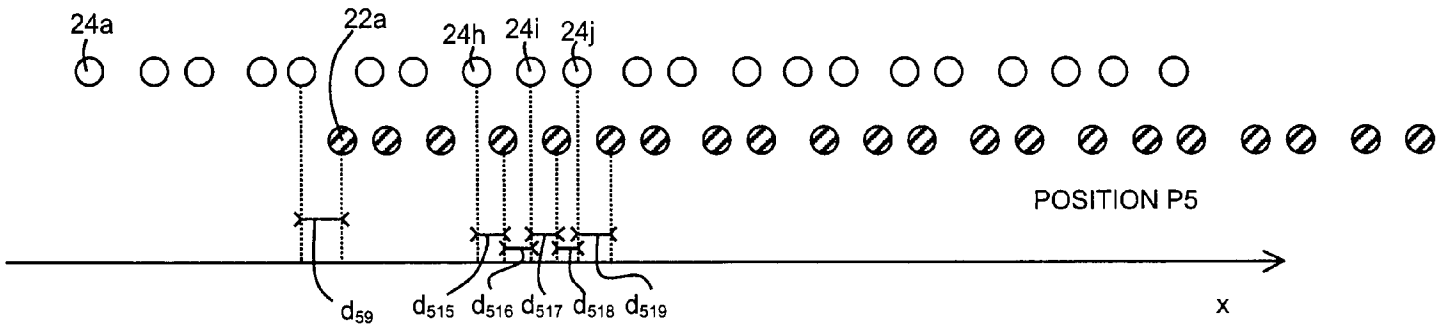
Figure 5F:
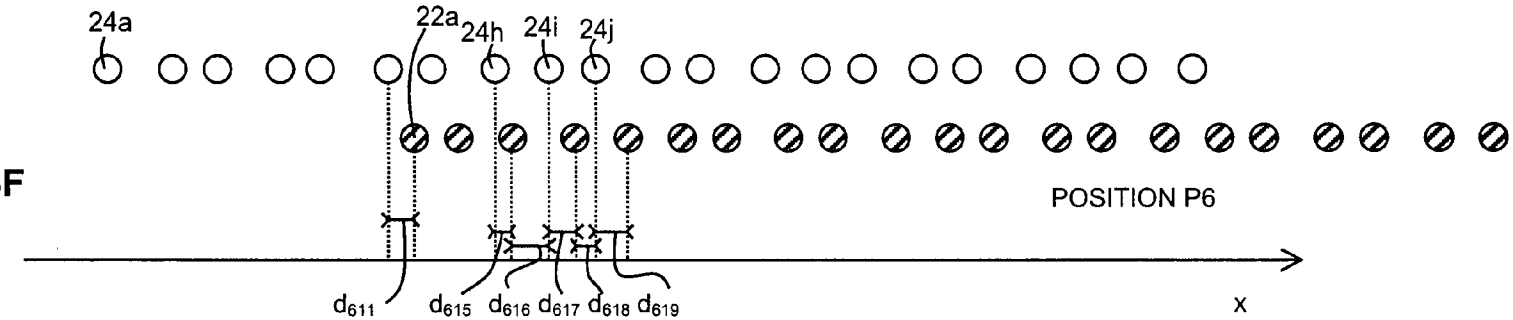

In step S8, a list of distances between first and second neighboring marks is also computed for the position P2 (see FIG. 5B). Since the nozzle 20*a* is not usable anymore and since the relative position is shifted by a distance equal to one pitch p, the first distance of the list for the position P2 is $d_{23}$, the projected distance between the first mark 22*a* and the second mark 24*b*. Due to the shift by one pitch, $d_{23}$ is obtained by the following relationship: $d_{23}$=x22*a*+p−x24*b*. Other examples are $d_{215}$=x22*g*+p−x24*h*; $d_{216}$=x24*i*−x22*g*−p and so on.

In step S8, similarly, a list of distances between first and second neighboring marks is also computed for the position P3. Now, the nozzles 24*a* and 24*b* are not usable anymore, since the relative position of the first and second arrays is shifted by a distance equal to two pitches (2p) compared to the initial position. The first distance of the list corresponding to the position P3 is then $d_{35}$ which is given by the following relationship $d_{35}$=x22*a*+2p−x24*c*. Other examples in the position P3 are $d_{315}$=x22*f*+2p−x24*h*; $d_{316}$=x24*i*−x22*f*−2p and so on. Based on the x-coordinates represented in a table in FIG. 6, a list $L_3$ of distances between first and second neighboring marks is computed for the relative position P3 and is illustrated in FIG. 7B.

Once a list of distances between first and second neighboring marks has been calculated for each one of the attainable positions P1, P2, P3, P4, P5 and P6, the program running on the control unit 11 proceeds to step S10.

In step S10, a so-called deviation factor F is extracted by control unit 11 for each one of the list of distances. The deviation factor F is an attribute of the relative position (P1 or P2 or P3 etc.) and is indicative of an amount by which distances between first and second neighboring marks deviate from the nominal distance. A deviation factor is actually indicative of an amount by which the distances in a list (in $L_1$ or $L_3$, for example) deviate from the nominal distance. As explained above, the nominal distance may be the projected distance onto the x-axis between adjacent first and second marks in the ideal case. The nominal value is in the present example equal to half the pitch of the nozzles in a row, i.e. 40 a.u. It is seen in the list $L_1$ of FIG. 7A that some distances between first and second neighboring marks deviate significantly from the nominal value of 40 a.u. The differences Δn computed between the nominal distance and the distances between neighboring first and second marks are exemplified in the second part of the list $L_1$ and $L_3$. For example, the difference $\Delta_{11}$ is obtained by the following relationship $\Delta_{11}=40-d_{11}$, wherein 40 is the nominal distance.

A maximum function may constrain the deviation factor attributed to a distinct attainable relative position to take the value of the largest difference, in absolute value, among the ensemble of differences Δn computed between the nominal distance and the distances between neighboring first and second marks. The deviation factor for a given list (corresponding to an attainable relative position) may thus be equal to the largest Δn found in the list. Indeed, the larger the value(s) is/are, the more visible the defect(s) will be. When the deviation factor for a list is set to be the largest difference, in absolute value, among the ensemble of differences Δn computed between the nominal distance and the distances between neighboring first and second marks, the deviation factor is clearly indicative of a degree of deviation from an ideal situation. The deviation factor $F_1$ for the list $L_1$ (see the greyed area in the list $L_1$ of FIG. 7A) is 30 a.u., corresponding to $\Delta_{19}$. For each list, corresponding to each attainable position, the deviation factor is extracted. For example, the deviation factor $F_3$ for the list $L_3$ (see the greyed areas in the list $L_3$ of FIG. 7B) is 20 a.u. corresponding to a number of difference $\Delta n(\Delta_{35}, \Delta_{310}, \Delta_{313}$, etc.).

In the next step (S 12), a selection module of the control unit 11 selects a relative attainable position among the plurality of relative attainable positions. The selected relative position has to satisfy a selection criterion which is applied to the deviation factors attributed to the plurality of relative attainable positions. An optimum attainable position is thus selected based on the extracted plurality of deviation factors $F_1 \ldots F_3$, etc. For example, a relative attainable position satisfies the selection criterion when the deviation factor attributed to the relative position is the smallest among the attributed deviation factors. In the example described here, not all lists have been illustrated. However, all lists are computed by the analysis module of the control unit 11 and it appears that the list $L_3$ is characterized by the smallest deviation factor, which is $F_3$ equal to 20 a.u., as indicated above. Therefore, the position P3 (FIG. 5C) appears to be the most favorable relative position for the arrays 12 and 14. The position P3 is selected by the selection module of the control unit 11.

In step S14, a signal is sent by the control unit 11 to the displacement device 16 for displacing the array 14 thereby bringing the first and second arrays in the selected relative position, which is position P3. The arrays are thus shifted from the initial position P1 by a distance equal to two pitches (2p).

In step S16, the program is ended. The first and second arrays are now in an optimum relative position, and the printing device can be used for recorded patterns. After a certain period, or after a certain amount of recording, the deviation angles associated with the nozzles may evolve. Therefore, the method, as illustrated by the flowchart of FIG. 10, has to be carried out again. Possibly, another relative position will be selected.

Figures 8A, 8B, 9:
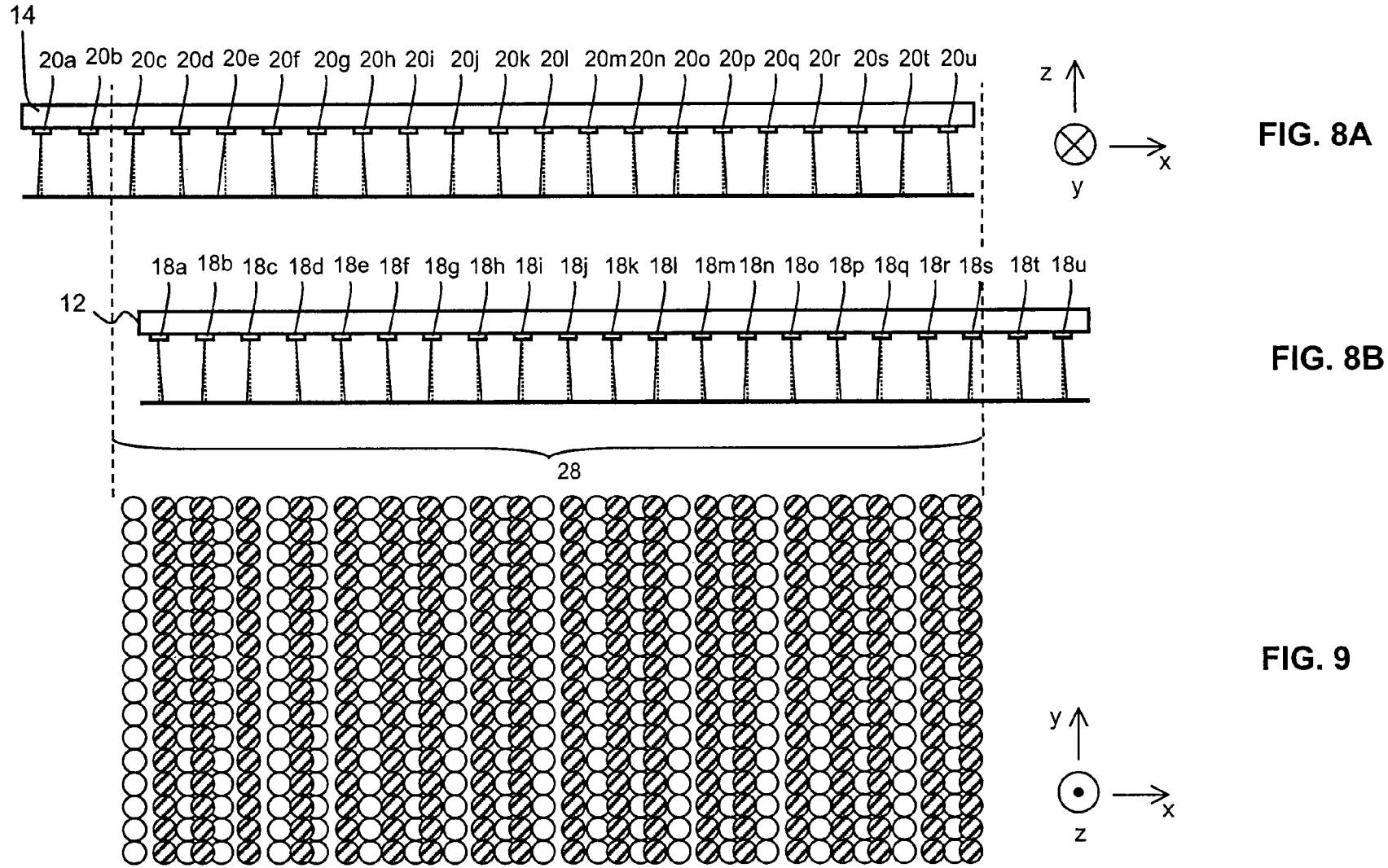
FIGS. 8A and 8B are cross-sectional views of the first and second arrays in the relative position 3.
FIG. 9 is a schematic representation of a printed pattern when the arrays are aligned according to the method of the present invention.

The position P3 is illustrated by FIGS. 8A and 8B, wherein each one of the arrays 14 and 12 is represented in a cross-sectional view. The overlapping area 28 is also shown. An example of a pattern that may be recorded by the arrays in the illustrated arrangement is shown in FIG. 9. As explained above, the nozzles 20*a*, 20*b*, 18*t* and 18*u* are not usable anymore, since they find themselves outside of the overlapping area 28. Therefore, these nozzles are set inactive by the control unit 11. On the other hand, the nozzles 20*c* to 20*u* and 18*a* to 18*s* find themselves within the overlapping area and may be activated image-wise by the control unit. In the case that all of said nozzles finding themselves within the overlapping area are activated to form the pattern shown in FIG. 9, a full recorded surface is obtained. Compared to the pattern shown in FIG. 3, obtained with the alignment method of the background art, the phenomenon of banding is less visible. Defects still exist (areas not filled, areas wherein marks overlap); however, at least one large defect has been suppressed compared to the pattern obtained in FIG. 3. Indeed, the area 23 in FIG. 3 with a large empty band has disappeared in the pattern of FIG. 9.

In the example discussed above, the position P3 appears to be the most advantageous relative position of the arrays 12 and 14. In the example illustrated by FIGS. 8A and 8B, eighteen nozzles from the first row and eighteen nozzles from the second row find themselves in the overlapping area. These in total thirty-six nozzles are activated image-wise in order to record a pattern. If another position had been found to be optimum, a different number of nozzles would find themselves in the overlapping area. For the position P6 (see FIG. 5F), sixteen nozzles from the first row and sixteen nozzles from the second row find themselves in the overlapping area (in total thirty-two nozzles). It might be undesirable to render the number of nozzles to be image-wise activated dependent on the optimum relative position. Instead, a pre-defined number of nozzles for image-wise activation may be chosen. This number may be equal to the number of nozzles finding themselves in the overlapping area when the arrays are in the most shifted possible position. In the example above, that would mean that, independently from the optimum found for the relative position, the number of image-wise to be activated nozzles would be thirty-two, i.e. the number of nozzles in the overlapping area when the arrays are in the position P6. If such a choice was made, in the optimum relative position P3, only thirty-two nozzles in the overlapping area would be chosen for image-wise activation. The choice may be based again on a best possible relative positioning of the first and second marks within the overlapping area.

Figure 11:
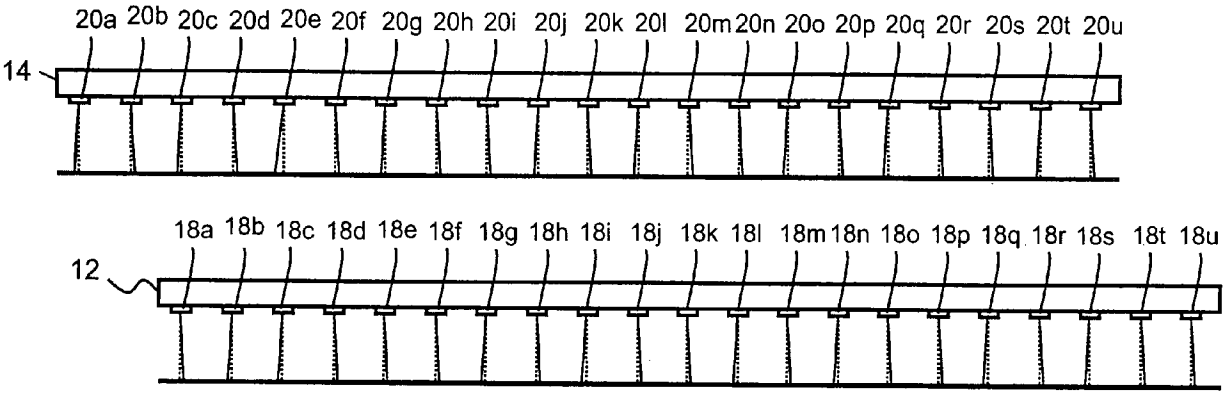
FIG. 11 shows cross-sectional views of the first and second arrays in a relative position suited for printing overlapping pixel lines.

In another embodiment of the method according to the present invention, the first and second arrays are adjusted respectively to each other such that the nominal distance is zero. The adjustment with a nominal distance equal to zero is, for example, interesting for applications wherein marks formed by ink of a first type have to be printed at the same locations on the recording substrate as marks formed by ink of a second type. In a printing device according to an embodiment of the present invention, the nozzles of the first array are regularly spaced according to a pitch and the nozzles of the second array are regularly spaced according to the same pitch. When the first and second arrays are adjusted respectively to each other such that the nominal distance is zero, such as shown in FIG. 11, the pixel lines formed on the recording substrate by the nozzles of the first array overlap the pixel lines formed by the nozzles of the second array.

Figure 12A:
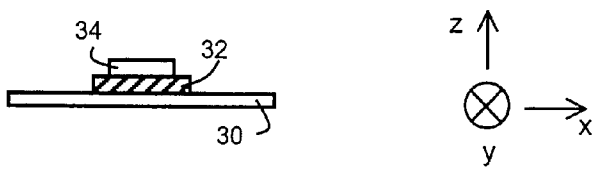
FIG. 12A illustrates an arrangement of marks for graphical applications.

The adjustment with a nominal distance equal to zero is interesting for graphical applications. The cross section of a possible resulting pattern is partly shown in FIG. 12A. On a recording substrate 30, marks 32 formed by ink droplets of a first colorant are printed by the first array. Shortly following the formation of the marks 32, marks 34 formed by ink droplets of a second colorant are printed on top of the marks 32, using the second array of nozzles. Of course, for graphical applications, more colorants may be used. For graphical applications, the deviation factor is preferably obtained by an average function which constrains the deviation factor attributed to a distinct attainable relative position to take the value of an averaged difference, computed in absolute value between the nominal distance and the distances between neighboring first and second marks. The selected attainable relative position is the one having the smallest deviation factor among the plurality of deviation factors. Consequently, the overlapping between first and second marks is on average as good as is possible.

Figure 12B:
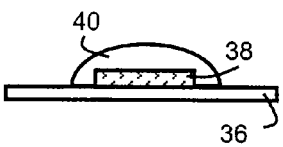
FIG. 12B illustrates an arrangement of marks for special applications such as printing etch-resist ink and/or conductive material for printed circuit board manufacturing.

The adjustment with a nominal distance equal to zero may also be interesting for special applications such as these related to the manufacturing of printed circuit boards. The cross section of a possible arrangement of the marks is partly shown in FIG. 12B. On an adequate recording substrate 36, first marks 38 are deposited by the nozzles of the first array. Preferably, the material used for forming the first marks 38 is an electrically conductive ink or a metal. If liquid metal is to be jetted by the nozzles of the first array, the printhead has to be adapted for expelling liquid metal droplets. On top of the first mark 38, a second mark 40 is formed. The material used for forming the marks 40 may be an electrically insulating ink. For printed circuit boards applications, the deviation factor is preferably obtained by a maximum function which constrains the deviation factor attributed to a distinct attainable relative position to take the value of the largest difference, in absolute value, among an ensemble of differences computed between the nominal distance and the distances between neighboring first and second marks. The selected attainable relative position is the one having the smallest deviation factor among the plurality of deviation factors. Consequently, the largest errors in the overlap between first and second marks are, as much as possible, avoided. This is of great importance for printed circuit boards applications, to ensure good electrical insulation between conductive tracks, where it is required on the board.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for adjusting a first array and a second array relative to each other in a printing device, the printing device having a carrying structure for mounting the first array and that second array, the first array having nozzles arranged in a first row substantially parallel to a first direction for forming first marks on a recording substrate, the second array having nozzles arranged in a second row substantially parallel to the first direction for forming second marks on the recording substrate, wherein in an attainable relative position, the first array and the second array at least partially flank each other, thereby defining a degree of longitudinal overlap along the first direction, the method comprising the steps of:

forming a test pattern having first and second test marks;

detecting the locations of the first and second test marks;

determining a plurality of deviation factors for a plurality of attainable relative positions based on the detected locations, wherein each one of said plurality of deviation factors is an attribute of a distinct attainable relative position and is indicative of an amount by which distances between neighbouring first and second marks deviate from a nominal distance; and selecting an attainable relative position among the plurality of attainable relative positions that has the smallest deviation factor among the plurality of deviation factors, wherein a maximum function constrains the deviation factor attributed to a distinct attainable relative position to take the value of the largest difference, in absolute value, among an ensemble of differences computed between the nominal distance and the distances between neighbouring first and second marks.

2. The method for adjusting a first array and a second array according to claim 1, wherein a maximum function constrains the deviation factor attributed to a distinct attainable relative position to take the value of the largest difference between the nominal distance and the distances between neighbouring first and second marks.

3. The method for adjusting a first array and a second array according to claim 1, wherein a maximum function constrains the deviation factor attributed to a distinct attainable relative position to take the value of the largest difference between the distances between neighbouring first and second marks and the nominal distance.

4. The method for adjusting a first array and a second array according to claim 1, wherein the nozzles of the first array are regularly spaced according to a pitch and the nozzles of the second array are regularly spaced according to the same pitch.

5. The method for adjusting a first array and a second array according to claim 4, wherein the nominal distance is equal to half the pitch.

6. The method for adjusting a first array and a second array according to claim 4, wherein the nominal distance is equal to zero.

7. The method for adjusting a first array and a second array according to claim 1, further comprising the step of displacing at least one of the first array and the second array for bringing the first array and the second array into the selected relative attainable position.

8. A printing device comprising:

a first array and a second array mounted on a carrying structure, the first array having nozzles arranged in a first row substantially parallel to a first direction for forming first marks on a recording substrate, the second array having nozzles arranged in a second row substantially parallel to the first direction for forming second marks on the recording substrate, wherein in an attainable relative position, the first array and the second array at least partially flank each other, thereby defining a degree of longitudinal overlap along the first direction;

a displacement device that displaces at least one of the arrays thereby causing a change in a degree of the longitudinal overlap;

a control unit that controls the first array and the second array to form a test pattern having first and second test marks and controls a detecting unit that detects the locations of the first and second test marks; and a computing module for:

determining a plurality of deviation factors for a plurality of attainable relative positions based on said detected locations, wherein each one of said plurality of deviation factors is an attribute of a distinct attainable relative position and is indicative of an amount by which distances between neighbouring first and second marks deviate from a nominal distance; and a selection module for:

selecting an attainable relative position among the plurality of attainable relative positions that has the smallest deviation factor among the plurality of deviation factors, wherein the computing module is programmed to constrain the deviation factor attributed to a distinct attainable relative position by a maximum function to take the value of the largest difference, in absolute value, among an ensemble of differences computed by the computing module between the nominal distance and the distances between neighbouring first and second marks.

9. The printing device according to claim 8, wherein the control unit controls the displacement device to cause the first and second arrays to have a degree of longitudinal overlap corresponding to the selected attainable relative position.

10. The printing device according to claim 8, wherein the detecting unit is a camera mounted on a carriage and arranged for scanning the test pattern.

11. The printing device according to claim 10, wherein the camera is a CCD camera that is arranged for determining a geometrical center of gravity of each one of the first and second test marks in the test pattern and extracting coordinates of said first and second test marks along an axis.

12. The printing device according to claim 8, wherein the nozzles of the first array are regularly spaced according to a pitch and the nozzles of the second array are regularly spaced according to the same pitch.

13. The printing device according to claim 12, wherein the nominal distance is equal to half the pitch.

14. The printing device according to claim 12, wherein the nominal distance is equal to zero.

15. The printing device according to claim 8, wherein the first array and the second array are mounted on a carriage as the mounting structure, and the carriage and the recording substrate are moveable relative to each other in a second direction normal to the first direction.

16. The printing device according to claim 8, wherein the displacement device comprises a piezoelectrical actuator.

17. The printing device according to claim 8, wherein the printing device is an ink jet printer.

18. A computer program product residing on a computer readable medium comprising instructions for causing at least one process unit to perform a method for adjusting a first array and a second array relative to each other in a printing device, the printing device having a carrying structure for mounting the first array and that second array, the first array having nozzles arranged in a first row substantially parallel to a first direction for forming first marks on a recording substrate, the second array having nozzles arranged in a second row substantially parallel to the first direction for forming second marks on the recording substrate, wherein in an attainable relative position, the first array and the second array at least partially flank each other, thereby defining a degree of longitudinal overlap along the first direction, the method comprising the steps of:

forming a test pattern having first and second test marks;

detecting the locations of the first and second test marks;

determining a plurality of deviation factors for a plurality of attainable relative positions based on the detected locations, wherein each one of said plurality of deviation factors is an attribute of a distinct attainable relative position and is indicative of an amount by which distances between neighbouring first and second marks deviate from a nominal distance; and selecting an attainable relative position among the plurality of attainable relative positions that has the smallest deviation factor among the plurality of deviation factors; and wherein a computing module is programmed to constrain the deviation factor attributed to a distinct attainable relative position by a maximum function to take the value of the largest difference, in absolute value, among an ensemble of differences computed by the computing module between the nominal distance and the distances between neighbouring first and second marks.

* * * * *